US011247270B2

(12) United States Patent
Wang et al.

(10) Patent No.: US 11,247,270 B2
(45) Date of Patent: Feb. 15, 2022

(54) METHOD FOR PREPARING VANADIUM AND VANADIUM ALLOY POWDER FROM VANADIUM-CONTAINING MATERIALS THROUGH SHORTENED PROCESS

(71) Applicant: CHENGDE BRANCH OF HBIS GROUP, Hebei (CN)

(72) Inventors: Na Wang, Hebei (CN); Xindong Wang, Hebei (CN); Ruiguo Bai, Hebei (CN); Chunliang Wu, Hebei (CN); Qichen Hu, Hebei (CN); Baohua Wang, Hebei (CN); Ruifeng Ma, Hebei (CN)

(73) Assignee: Na Wang, Chengde (CN)

( * ) Notice: Subject to any disclaimer, the term of this patent is extended or adjusted under 35 U.S.C. 154(b) by 369 days.

(21) Appl. No.: 16/447,076

(22) Filed: Jun. 20, 2019

(65) Prior Publication Data

US 2020/0246875 A1 Aug. 6, 2020

(30) Foreign Application Priority Data

Jan. 31, 2019 (CN) ..... 201910100340.4

(51) Int. Cl.
*B22F 9/20* (2006.01)
*B22F 9/04* (2006.01)
(Continued)

(52) U.S. Cl.
CPC ..... *B22F 9/20* (2013.01); *B22F 9/04* (2013.01); *C22B 1/02* (2013.01); *C22B 3/44* (2013.01);
(Continued)

(58) Field of Classification Search
CPC .... B22F 9/04; B22F 9/20; B22F 9/245; B22F 2009/245
See application file for complete search history.

(56) References Cited

U.S. PATENT DOCUMENTS 1,814,720 A * 7/1931 Marden ..... C22B 34/22 75/622
3,856,512 A * 12/1974 Palmer ..... C22B 34/1204 75/430
(Continued)

FOREIGN PATENT DOCUMENTS

CN 102732727 B 1/2014
CN 103276227 B 12/2014
(Continued)

OTHER PUBLICATIONS

Marden, J. W., and M. N. Rich. "Vanadium1." Industrial & Engineering Chemistry 19.7 (1927): 786-788 (Year: 1927).*
(Continued)

*Primary Examiner* — Anthony J Zimmer
*Assistant Examiner* — Sean P. O'Keefe

(57) ABSTRACT

Disclosed is a method for preparing vanadium or vanadium alloy powder from a vanadium-containing raw material through a shortened process, including: calcinating a mixture of a vanadium-containing raw material and an alkali compound for oxidation to form a water-soluble vanadate; purifying the vanadate followed by vanadium precipitation to produce an intermediate $CaV_2O_6$ with high purity; dissolving $CaV_2O_6$ in a molten-salt medium together with other raw materials to form a uniform reaction system; and introducing a reducing agent to the system followed by separation, washing and drying to produce vanadium or vanadium alloy powder having a particle size of 50-800 nm and a purity of 99.0 wt % or more. The method can continuously process vanadium-containing raw materials to prepare vanadium or vanadium alloy powder.

19 Claims, 4 Drawing Sheets

(51) Int. Cl.

| | |
|---|---|
| ***C22B 1/02*** | (2006.01) |
| ***C22B 34/22*** | (2006.01) |
| ***C22B 3/44*** | (2006.01) |
| ***B22F 9/24*** | (2006.01) |
| ***C22C 1/04*** | (2006.01) |
| ***C22C 27/02*** | (2006.01) |

(52) U.S. Cl.

CPC ..... *C22B 34/22* (2013.01); *C22C 27/025* (2013.01); *B22F 2009/049* (2013.01); *B22F 2009/245* (2013.01); *B22F 2203/11* (2013.01); *B22F 2301/00* (2013.01); *B22F 2303/30* (2013.01); *B22F 2304/054* (2013.01); *B22F 2304/056* (2013.01); *B22F 2304/058* (2013.01); *B22F 2998/10* (2013.01); *B22F 2999/00* (2013.01); *C22C 1/045* (2013.01)

(56) References Cited

U.S. PATENT DOCUMENTS

| | | | | |
|---|---|---|---|---|
| 4,670,229 | A * | 6/1987 | Wiewiorowski | C22B 23/0446 423/55 |
| 2017/0209933 | A1* | 7/2017 | Wang | B22F 9/24 |
| 2021/0130928 | A1* | 5/2021 | Lee | C22B 34/365 |

FOREIGN PATENT DOCUMENTS

| | | | |
|---|---|---|---|
| CN | 104120271 | B | 9/2018 |
| CN | 106636646 | B | 9/2018 |

OTHER PUBLICATIONS

Cai (Cai, Zhuo-fei, et al. "Direct electrochemical reduction of solid vanadium oxide to metal vanadium at low temperature in molten CaCl 2—NaCl." International Journal of Minerals, Metallurgy, and Materials 19.6 (2012): 499-505) (Year: 2012).*

* cited by examiner

METHOD FOR PREPARING VANADIUM AND VANADIUM ALLOY POWDER FROM VANADIUM-CONTAINING MATERIALS THROUGH SHORTENED PROCESS

CROSS-REFERENCE TO RELATED APPLICATIONS

This application claims the benefit of priority from Chinese Patent Application No. 201910100340.4, filed on Jan. 31, 2019. The content of the aforementioned application, including any intervening amendments thereto, is incorporated herein by reference in its entirety.

TECHNICAL FIELD

The present disclosure relates to metallurgical engineering, and more particularly to a method for preparing vanadium and vanadium alloy powder from a vanadium-containing raw material through shortened process.

BACKGROUND OF THE INVENTION

Vanadium, known as "rare metal" and "strategic metal", is almost applied to all the fields of ferrous or non-ferrous alloys due to its desirable physical properties such as high melting point, tensile strength, hardness and fatigue resistance. Moreover, vanadium and its alloys also have the characteristics such as excellent processability, high corrosion resistance and extremely small absorption cross section for fast neutrons, so that they are suitable as new aerospace and atomic energy materials in aerospace industry, atomic energy industry, superconductive alloy materials, additives for special alloys and electronic industry. At present, there are many methods for producing vanadium and vanadium alloys, including gas atomization (GA) method, mechanical alloying (MA) method, electrochemical deposition method and chemical reduction method.

The atomization method mainly includes dual-fluid atomization, centrifugal atomization and vacuum melting atomization. The electrode induction smelting gas atomization (EIGA) method comprises the following steps. The tip of an alloy rod is gradually placed into a metallic copper induction coil for heating and melting, and the alloy droplets continuously dripping from the alloy rod are dispersed by the high-speed airflow jetted from a nozzle, and then are rapidly cooled and solidified. The solidified products are collected by a cyclone collector into a powder storage tank. By this technique, pure and impurity-free alloy powder can be obtained in the absence of melting with a crucible.

Mechanical alloying (MA) technology is used in the substitute technology of powder processing, where powder of different elements repeatedly collide and rub between grinding balls for breaking and miscible diffusion, thereby achieving the grinding and alloying.

The preparation of pre-alloyed powder Ti6Al4V is taken as an example, where HDHTi and 6Al-4V powder with a particle size less than 200 mesh and a purity more than 99 wt % are mixed in a weight ratio of 9:1, and then the mixture is transferred to a stainless grinding tank of an XQM-2L planetary ball mill followed by mechanical ball milling at 330 rpm to prepare the pre-alloyed powder Ti-6Al-4V, where the number of the small-sized balls with a diameter of 8 mm is five times more than that of the large-sized balls with a diameter of 20 mm, and a volume ratio of the balls to the mixture is 20:1.

The electrochemical deposition method includes electrochemical deposition in aqueous solution and molten-salt electrochemical method. The molten-salt electrochemical method is mainly used to prepare some rare refractory metal powder, and the molten-salt electrochemical deposition method is a new technique for preparing metallic vanadium powder based on FFC process (Fray-Farthing-Chen Cambrige process). Though this process is still in the laboratory stage, it has been found to have the characteristics such as simple and convenient operation. However, this method is prone to producing CO, $CO_2$, or a mixture of CO and $CO_2$, which causes air pollution, limiting its application.

The chemical reduction method includes calciothermic reduction method, magnesiothermic reduction method and molten-salt chemical reduction method. By the calciothermic reduction method, Marden and Rich et al. firstly prepared small metallic vanadium particles from $V_2O_5$ in the presence of a flux $CaCl_2$. Mckechnic and Seybolt et al. introduced a heat-increasing agent or a flux $CaI_2$ during the reduction process to improve the heat release of the calciothermic reduction, producing a metallic vanadium block having good ductility and a purity of about 99.5 wt %. However, the metallic vanadium block obtained by this method is hard due to a high impurity content, which is not conducive to mechanical processing, thereby limiting the application of the product.

According to raw materials, the magnesiothermic reduction method can be divided into hydrogen-magnesium thermal reduction of $V_2O_5$ and magnesiothermic reduction of $VCl_3$. In the method of hydrogen-magnesium thermal reduction of $V_2O_5$, $V_2O_5$ is first reduced with hydrogen to form intermediate products including $V_2O_3$ and VO, and then the intermediate products are subjected to magnesiothermic reduction at 690° C. to obtain vanadium. Compared to other methods, this method has lower energy consumption, but it also has the disadvantages such as complicated process and equipment, which limits its application. In addition, Frank et al. used molten magnesium and a mixture of sodium and magnesium as a reducing agent to reduce $VCl_3$ by metal thermal reaction to prepare a crude sponge vanadium in a stainless reactor, which was then subjected to high-vacuum distillation to remove the excess reducing agent and by-product salts, preparing a pure sponge vanadium. Although this method obtains a high-purity metallic vanadium material by reduction, there are some problems in the post-treatment of the excess reducing agent and the by-product salts such as complicated equipment and difficult operations. Therefore, this method is still required to be improved.

There are some common problems in the above methods such as long process, complicated equipment, cumbersome operations, unfriendliness to environment and low quality when used for preparing vanadium and its alloys, making these methods unsuitable for large-scale promotion.

SUMMARY OF THE INVENTION

An object of the present disclosure is to develop a new method for preparing vanadium and vanadium alloy powder from a vanadium-containing raw material through shortened process to overcome the problems in the prior art. The new method has the characteristics such as short process, simple equipment, low energy consumption, and instantaneous reduction and is environmentally friendly, and thus has broad application prospects.

The technical solutions of the disclosure are described below.

The disclosure provides a method for preparing vanadium and vanadium alloy powder from a vanadium-containing raw material through a shortened process, comprising:

(1) mixing the vanadium-containing raw material with an alkali compound to produce a mixture, and then calcinating the mixture for oxidation;

(2) pulverizing the calcinated product obtained in step (1) to produce a vanadium-containing particles and then dissolving the vanadium-containing particles followed by solid-liquid separation to produce a vanadium-containing solution; purifying the vanadium-containing solution followed by adding with a calcium salt for vanadium precipitation to obtain an intermediate $CaV_2O_6$;

(3) mixing the intermediate $CaV_2O_6$ obtained in step (2) with a molten-salt medium to produce a mixture, and dehydrating the mixture under vacuum followed by heating for melting to form a molten-salt reaction system;

(4) adding a reducing agent to the molten-salt reaction system obtained in step (3) for thermal reduction reaction;

(5) subjecting the thermal-reduced product obtained in step (4) to solid-liquid separation, washing and drying to obtain a target product.

In an embodiment, the vanadium-containing raw material in step (1) may be any vanadium-containing raw material commonly used for vanadium preparation in the art, comprising a vanadium-containing ore, a vanadium-containing waste, a vanadium-containing slag, a vanadium-containing catalyst and a vanadium battery material. In an embodiment, the vanadium-containing material is vanadium-containing slag.

In an embodiment, in step (1), the alkali compound is at least one compound selected from the group consisting of $Na_2O$, $K_2O$, NaOH, KOH, $Na_2CO_3$ and $K_2CO_3$, preferably $Na_2CO_3$ and/or $K_2CO_3$.

In an embodiment, in step (1), in the mixture of the vanadium-containing raw material and the alkali compound, the vanadium-containing raw material has a molar percentage content of 5-25%, for example, 5%, 8%, 10%, 13%, 15%, 18%, 20%, 23% or 25%; and the alkali compound has a molar percentage content of 75-95%, for example, 75%, 78%, 80%, 83%, 85%, 88%, 90%, 93% or 95%.

In an embodiment, in step (1), a calcination temperature is 700-900° C., for example, 700° C., 730° C., 750° C., 780° C., 800° C., 830° C., 850° C., 880° C. or 900° C.

In an embodiment, in step (1), a calcination time is 3-10 h, for example, 3, 4, 5, 6, 7, 8, 9 or 10 h.

The disclosure converts the vanadium element in the vanadium-containing raw material into a water-soluble vanadate by the calcination in step (1).

In an embodiment, in step (2), the vanadium-containing particles have a particle size of 150-300 mesh.

The purification in step (2) is not particularly limited herein, and any conventional purification method in the art which can be used to remove the impurity elements such as Cr, Si and Fe in the vanadium solution without introducing new impurities is suitable.

In an embodiment, in step (2), the calcium salt is CaO and/or $CaCl_2$.

In step (2), the disclosure obtains the intermediate $CaV_2O_6$ with a purity greater than 98% by the operations including pulverization, dissolution, purification and vanadium precipitation.

In an embodiment, in step (3), the molten-salt medium consists of compound A and compound B, wherein the compound A is at least one compound selected from the group consisting of $CaCl_2$, NaF and KF and the compound B is at least one compound selected from the group consisting of NaCl, KCl, LiCl, $NaAlO_2$, $CaTiO_3$, $Na_2TiO_3$, $K_2TiO_3$ and $TiO_2$.

In an embodiment, in the molten-salt medium, the compound A has a molar percentage content of 40-100%, for example, 40%, 50%, 60%, 70%, 80%, 90% or 100%; and the compound B has a molar percentage content of 0-60%, for example, 0%, 10%, 20%, 30%, 40%, 50% or 60%.

In an embodiment, when the molar percentage content of the compound A in the molten-salt medium is 100%, the molar percentage content of the compound B is correspondingly 0%, that is, the compound A is used as the molten-salt medium.

In an embodiment, in step (3), in the mixture of $CaV_2O_6$ and the molten-salt medium, $CaV_2O_6$ has a molar percentage content of 2-12%, for example, 2%, 3%, 4%, 5%, 6%, 7%, 8%, 9%, 10%, 11% or 12%; and the molten-salt medium has a molar percentage content of 88-98%, for example, 88%, 89%, 90%, 91%, 92%, 93%, 94%, 95%, 96%, 97% or 98%.

In order to prevent the chloride from being hydrolyzed, vacuum dehydration is needed after the intermediate $CaV_2O_6$ is mixed with the molten-salt medium.

In an embodiment, in step (3) a vacuum degree is 0.1-0.3 MPa, for example, 0.1 MPa, 0.13 MPa, 0.15 MPa, 0.18 MPa, 0.2 MPa, 0.23 MPa, 0.25 MPa, 0.28 MPa or 0.3 MPa.

In an embodiment, in step (3), a the vacuum dehydration temperature is 150-450° C., for example, 150° C., 200° C., 250° C., 300° C., 350° C., 400° C. or 450° C.

In an embodiment, in step (3), a temperature of the molten-salt reaction system is 500-950° C., for example, 500° C., 550° C., 600° C., 650° C., 700° C., 750° C., 800° C., 850° C., 900° C. or 950° C.

In step (3), the intermediate $CaV_2O_6$ and other materials are completely dissolved in the molten-salt medium to form a homogeneous reaction system, in which the vanadium element is present as $V_2O_6^{2-}$. The molten-salt medium can dilute the reactants, and control the reaction rate and the release amount of reaction heat, facilitating the dissolution and the transfer of by-products and the progress of the reduction.

In an embodiment, in step (4), the reducing agent is at least one compound selected from the group consisting of sodium, calcium and magnesium.

In an embodiment, in step (4), a thermal reduction reaction temperature is 400-800° C., preferably 600-750° C., for example, 400° C., 450° C., 500° C., 550° C., 600° C., 650° C., 700° C., 750° C. or 800° C.

In an embodiment, in step (4), the thermal reduction reaction is carried out under a protective atmosphere, preferably under argon. In an embodiment, a flow rate of the argon is 10-40 mL/s.

In step (4), a metal such as sodium, calcium or magnesium is used as a reducing agent to produce the vanadium or vanadium alloy powder.

In step (5), the solid-liquid separation is performed by vacuum filtration to separate the target product from the molten-salt medium. Then, the obtained target product is washed sequentially with an acid and water, where the type and the concentration of the acid can be selected according to actual situation, and is not particularly limited herein.

In an embodiment, in step (5), the drying is performed under vacuum. In an embodiment, a vacuum degree is 0.1-0.5 MPa and a temperature is 30-50° C.

In the above preparation process, if only the intermediate $CaV_2O_6$ is mixed with the molten-salt medium in step (3) for subsequent processes of heating, melting and reduction, the target product finally obtained is vanadium powder. The disclosure can also produce an alloy powder of vanadium and related metal(s) as the target product by optionally introducing an appropriate amount of other metal compounds in the mixing of the intermediate $CaV_2O_6$ with the molten-salt medium. For example, when an aluminum compound is added, the obtained target product is a V—Al alloy. Exemplarily, sodium metaaluminate may be added to prepare a V—Al alloy.

In another aspect, the disclosure provides a method for preparing vanadium and vanadium alloy powder from a vanadium-containing raw material through a shortened process, comprising:

(1) mixing the vanadium-containing raw material with an alkali compound to produce a mixture, and then calcinating the mixture at 700-900° C. for 3-10 h for oxidation;

wherein in the mixture of the vanadium-containing raw material and the alkali compound, the vanadium-containing raw material has a molar percentage content of 5-25% and the alkali compound has a molar percentage content of 75-95%; and the alkali compound is at least one compound selected from the group consisting of $Na_2O$, $K_2O$, NaOH, KOH, $Na_2CO_3$ and $K_2CO_3$;

(2) pulverizing the calcinated product obtained in step (1) to produce vanadium-containing particles of 150-300 mesh and then dissolving the vanadium-containing particles followed by solid-liquid separation to produce a vanadium-containing solution; purifying the vanadium-containing solution followed by adding with CaO and/or $CaCl_2$ for vanadium precipitation to obtain an intermediate $CaV_2O_6$;

(3) mixing the intermediate $CaV_2O_6$ obtained in step (2) with a molten-salt medium to produce a mixture, and dehydrating the mixture at a vacuum degree of 0.1-0.3 MPa and a temperature of 150-450° C. followed by heating to 500-950° C. for melting to form a molten-salt reaction system;

wherein the molten-salt medium consists of 40-100% by molar percentage content of compound A and 0-60% by molar percentage content of compound B; and the compound A is at least one compound selected from the group consisting of $CaCl_2$, NaF and KF, and the compound B is at least one compound selected from the group consisting of NaCl, KCl, LiCl, $NaAlO_2$, $CaTiO_3$, $Na_2TiO_3$, $K_2TiO_3$ and $TiO_2$;

in the mixture of $CaV_2O_6$ and the molten-salt medium, $CaV_2O_6$ has a molar percentage content of 2-12% and the molten-salt medium has a molar percentage content of 88-98%; and sodium metaaluminate is introduced during the mixing of the intermediate $CaV_2O_6$ with the molten-salt medium;

(4) adding a reducing agent to the molten-salt reaction system obtained in step (3) to carry out a thermal reduction reaction at 400-800° C. under an argon atmosphere; wherein the reducing agent is at least one compound selected from the group consisting of sodium, calcium and magnesium; and (5) subjecting the thermal-reduced product obtained in step (4) to vacuum filtration followed by washing sequentially with an acid and water and drying at a vacuum degree of 0.1-0.5 MPa and a temperature of 30-50° C. to obtain a target product.

Compared to the prior art, the present disclosure has the following beneficial effects.

(1) In the disclosure, the vanadium-containing raw material and the alkali compound are firstly calcinated for oxidation to form a water-soluble vanadate, which then undergoes purification and vanadium precipitation to produce an intermediate $CaV_2O_6$. $CaV_2O_6$ is dissolved in the molten-salt medium together with other raw materials to form a uniform reaction system, which is subsequently reduced with the reducing agent to obtain vanadium or vanadium alloy nano powder with a particle size of 50-800 nm and a purity of 99.0 wt % or more.

(2) The method provided by the disclosure can continuously process vanadium-containing materials to prepare vanadium or vanadium alloy powder. The obtained materials have high purity and small particle size, suitable as raw materials for spray coating, powder metallurgy and 3D printing and also suitable in aerospace, atomic energy industry, military industry, superconducting alloy materials, transportation, electronics industry, additives for special alloys and high-tech industries such as communications.

(3) Compared to the current preparation of vanadium and vanadium alloy, the method provided by the disclosure has the characteristics such as short process, simple equipment, low energy consumption, green production and excellent product. Moreover, it involves no production of harmful solid/liquid substances, thereby avoiding polluting the environment and allowing for huge economic and social benefits.

(4) The method provided by the disclosure is also applicable to the preparation of other refractory metals and alloys, rare earth metals, intermetallic compounds, and the like, and thus has good application prospects.

The disclosure will be further described in detail below with reference to the embodiments. However, the following embodiments are merely illustrative of the disclosure and are not intended to limit the scope of the disclosure. The scope of the disclosure is defined by the appended claims.

DETAILED DESCRIPTION OF EMBODIMENTS

The technical solutions of the disclosure will be further described below with reference to the accompanying drawings and embodiments.

EXAMPLE 1

This example provided a method for preparing vanadium powder from a vanadium-containing raw material through a shortened process, which was carried out according to the following steps.

(1) 200 g of vanadium slag and 24 g of $Na_2CO_3$ were uniformly mixed, pressed into a block, and calcinated in a furnace at 800° C. for 6 h for oxidation.

(2) The calcinated product obtained in step (1) was cooled to room temperature and pulverized into particles having a particle size of 200 mesh. The particles were sequentially washed with water, dissolved, filtered, purified and added with $CaCl_2$ for vanadium precipitation to obtain an intermediate $CaV_2O_6$.

(3) The intermediate $CaV_2O_6$ obtained in step (2) was mixed with a NaCl—$CaCl_2$ molten-salt medium in a molar ratio of 3:97 and melted in a reaction furnace at 650° C. to form a molten-salt reaction system, where the molar contents of NaCl and $CaCl_2$ in the molten-salt medium were 48% and 52%, respectively.

(4) The molten-salt reaction system obtained in step (3) was added with metal calcium as a reducing agent and reacted at 600° C. under the protection of argon for 6 h for thermal reduction, where a flow rate of the argon was 30 mL/s. After the reaction was completed, the reaction mixture was cooled to room temperature.

(5) The thermal-reduced product obtained in step (4) was filtered under vacuum to separate a target product from the molten-salt medium. Then the target product was washed sequentially with a diluted hydrochloric acid having a concentration of 3-5 wt % and distilled water, and dried at a vacuum degree of 0.3 MPa and a temperature of 40° C. to obtain the target product (V powder).

Figure 1:
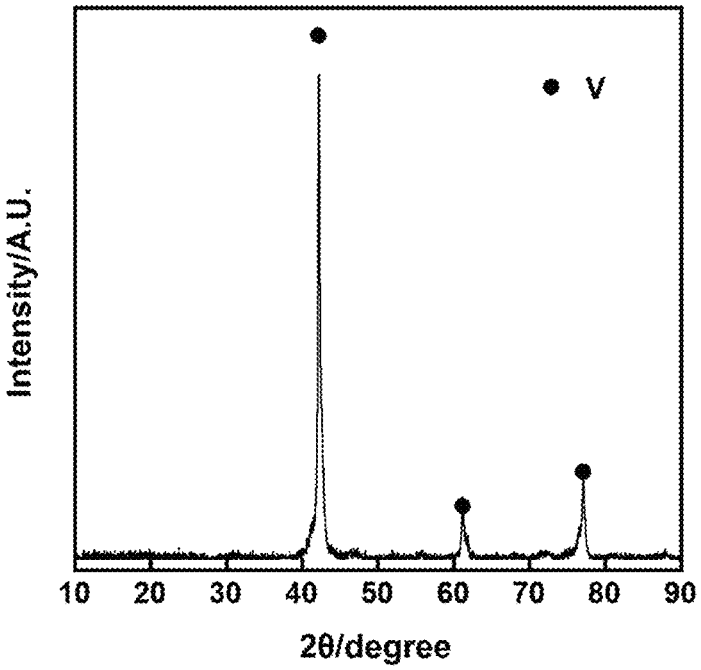
FIG. 1 is a graph showing XRD phase analysis of the V nanopowder prepared in Example 1 of the disclosure.
Figure 2:
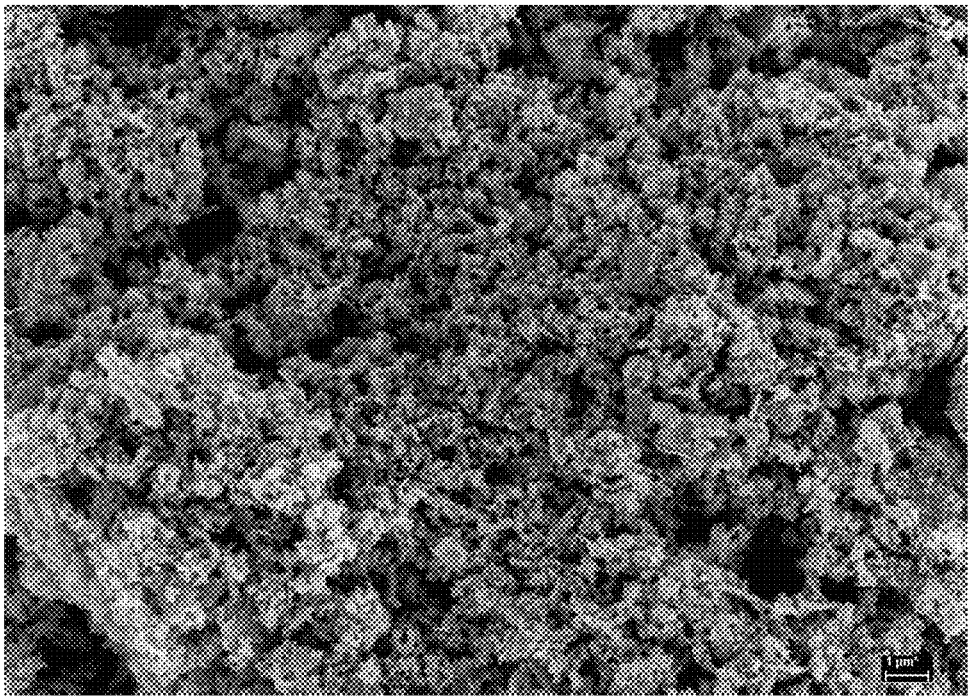
FIG. 2 is a FESEM image of the V nanopowder prepared in Example 1 of the disclosure.

The prepared target product was characterized by XRD phase analysis and FESEM surface morphology. As shown in FIG. 1, the XRD phase analysis showed that the product obtained in this example was an elemental metal V; and as shown in FIG. 2, the obtained V nanopowder was spherically-agglomerated particles having a particle size of 50-250 nm. The test results showed that the V powder had a purity of 99.15 wt %.

EXAMPLE 2

This example provided a method for preparing a vanadium alloy powder from a vanadium-containing raw material through a shortened process, which was carried out according to the following steps.

(1) 200 g of vanadium slag and 35 g of $K_2CO_3$ were uniformly mixed, pressed into a block, and calcinated at 850° C. in a furnace for 8 h for oxidation.

(2) The calcinated product obtained in step (1) was cooled to room temperature and pulverized into particles having a particle size of 200 mesh. The particles were sequentially washed with water, dissolved, filtered, purified and added with CaO for vanadium precipitation to obtain an intermediate $CaV_2O_6$.

(3) The intermediate $CaV_2O_6$ obtained in step (2) was mixed with sodium metaaluminate and a KCl—NaCl—$CaCl_2$ molten-salt medium in a molar ratio of 2.5:8:89.5, and melted at 750° C. in a reaction furnace to form a molten-salt reaction system, where the molar contents of KCl, NaCl and $CaCl_2$ in the molten-salt medium were 20%, 20% and 60%, respectively.

(4) The molten-salt reaction system obtained in step (3) was added with metal sodium as a reducing agent and reacted at 650° C. under the protection of argon for 8 h for thermal reduction reaction, where a flow rate of argon was 35 mL/s. After the reaction was completed, the reaction mixture was cooled to room temperature.

(5) The thermal-reduced product obtained in step (4) was filtered under vacuum to separate a target product from the molten-salt medium. Then the target product was washed sequentially with a diluted hydrochloric acid having a concentration of 3-5 wt % and distilled water, and dried at a vacuum degree of 0.2 MPa and a temperature of 45° C. to obtain the target product (V—Al alloy powder).

Figure 3:
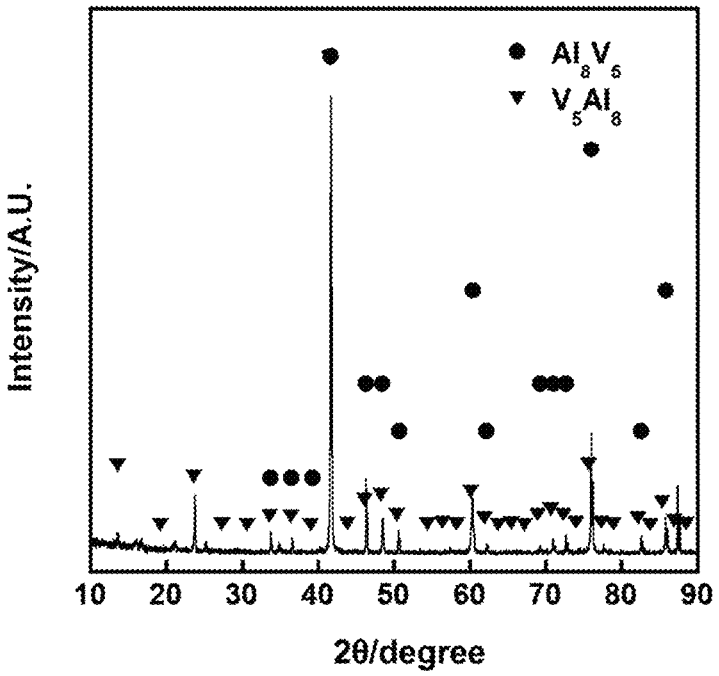
FIG. 3 is a graph showing XRD phase analysis of the V—Al alloy nanopowder prepared in Example 2 of the disclosure.
Figure 4:
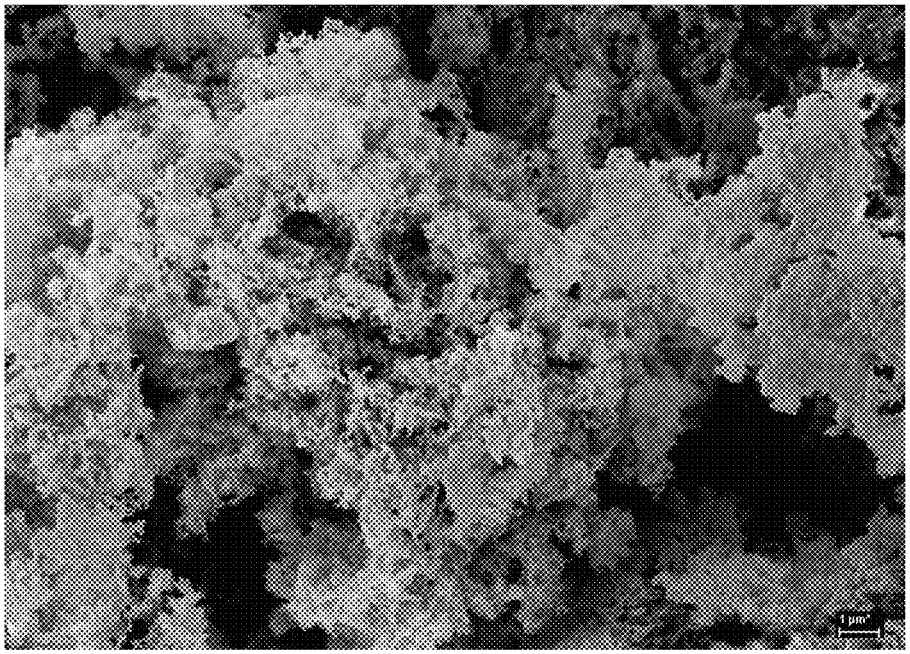
FIG. 4 is a FESEM image of the V—Al alloy nanopowder prepared in Example 2 of the disclosure.

The prepared target product was characterized by XRD phase analysis and FESEM surface morphology. As shown in FIG. 3, the XRD phase analysis showed that the product obtained in this example was a V—Al alloy; and as shown in FIG. 4, the obtained V—Al alloy nanopowder was spherically-agglomerated particles having a particle size of 100-300 nm. The test results showed that the obtained V—Al alloy powder had a purity of 99.15 wt %.

EXAMPLE 3

This example provided a method for preparing vanadium powder from a vanadium-containing raw material through a shortened process, which was carried out according to the following steps.

(1) 200 g of vanadium slag and 30 g of $K_2CO_3$ were uniformly mixed, pressed into a block, and calcinated at 900° C. in a furnace for 3.5 h for oxidation.

(2) The calcinated product obtained in step (1) was cooled to room temperature and pulverized into particles having a particle size of 150 mesh. The obtained particles were sequentially washed with water, dissolved, filtered, purified and added with $CaCl_2$ for vanadium precipitation to obtain an intermediate $CaV_2O_6$.

(3) The intermediate $CaV_2O_6$ obtained in step (2) was mixed with a $CaCl_2$ molten-salt medium in a molar ratio of 10:90 and melted at 800° C. in a reaction furnace to form a molten-salt reaction system, where the molar content of $CaCl_2$ in the molten-salt medium was 100%.

(4) The molten-salt reaction system obtained in step (3) was added with metal magnesium as a reducing agent and reacted at 650° C. under the protection of argon for 5 h for thermal reduction reaction, where a flow rate of the argon was 30 mL/s.

(5) The thermal-reduced product obtained in step (4) was filtered under vacuum to separate a target product from the molten-salt medium. Then the target product was washed sequentially with a diluted hydrochloric acid having a concentration of 3-5 wt % and distilled water, and dried at a vacuum degree of 0.4 MPa and a temperature of 35° C. to obtain the target product (V powder).

The test results showed that the obtained V powder had a purity of 99.20 wt %.

Described above are preferred embodiments of the disclosure, which are not intended to limit the disclosure. Various simple modifications can be made to the technical solutions of the disclosure within the scope of the disclosure, which should fall within the scope of the disclosure.

It should be further noted that in the case of no contradiction, the specific technical features described in the above specific embodiments may be combined in any suitable manner. Therefore, the various possible combinations will not be described separately in the disclosure.

In addition, any combination of various embodiments of the disclosure made without departing from the spirit of the disclosure should fall within the scope of the disclosure.

What is claimed is:

1. A method for preparing vanadium powder or vanadium alloy powder from a vanadium-containing raw material, comprising:

(1) mixing the vanadium-containing raw material with an alkali compound to produce a first mixture, and then calcinating the first mixture for oxidation to produce a calcinated product;

(2) pulverizing the calcinated product obtained in step (1) to produce vanadium-containing particles and then dissolving the vanadium-containing particles followed by solid-liquid separation to produce a vanadium-containing solution; purifying the vanadium-containing solution followed by adding with a calcium salt for vanadium precipitation to obtain an intermediate $CaV_2O_6$;

(3) mixing the intermediate $CaV_2O_6$ obtained in step (2) with a molten-salt medium to produce a second mixture, and dehydrating the second mixture under vacuum followed by heating for melting to form a molten-salt reaction system;

(4) adding a reducing agent to the molten-salt reaction system obtained in step (3) for thermal reduction reaction to produce a thermal-reduced product; and (5) subjecting the thermal-reduced product obtained in step (4) to solid-liquid separation, washing and drying to obtain a target product;

wherein in step (3), sodium metaaluminate is added during the mixing of the intermediate $CaV_2O_6$ with the molten-salt medium.

2. The method of claim 1, wherein in step (1), the alkali compound is at least one compound selected from the group consisting of $Na_2O$, $K_2O$, NaOH, KOH, $Na_2CO_3$ and $K_2CO_3$.

3. The method of claim 2, wherein the alkali compound is $Na_2CO_3$ and/or $K_2CO_3$.

4. The method of claim 1, wherein in step (1), in the first mixture of the vanadium-containing raw material and the alkali compound, the vanadium-containing raw material has a molar percentage content of 5-25% and the alkali compound has a molar percentage content of 75-95%.

5. The method of claim 1, wherein in step (1), a calcination temperature is 700-900° C. and a calcination time is 3-10 h.

6. The method of claim 1, wherein in step (2), the vanadium-containing particles have a particle size of 150-300 mesh.

7. The method of claim 1, wherein in step (2), the calcium salt is CaO and/or $CaCl_2$.

8. The method of claim 1, wherein in step (3), the molten-salt medium consists of compound A and compound B; wherein the compound A is at least one compound selected from the group consisting of $CaCl_2$, NaF and KF; and the compound B is at least one compound selected from the group consisting of NaCl, KCl, LiCl, $NaAlO_2$, $CaTiO_3$, $Na_2TiO_3$, $K_2TiO_3$ and $TiO_2$.

9. The method of claim 8, wherein in the molten-salt medium, the compound A has a molar percentage content of 40-100% and the compound B has a molar percentage content of 0-60%.

10. The method of claim 1, wherein in step (3), in the second mixture of $CaV_2O_6$ and the molten-salt medium, $CaV_2O_6$ has a molar percentage content of 2-12%, and the molten-salt medium has a molar percentage content of 88-98%.

11. The method of claim 1, wherein in step (3), a vacuum degree is 0.1-0.3 MPa, and a vacuum dehydration temperature is 150-450° C.

12. The method of claim 1, wherein in step (3), a temperature of the molten-salt reaction system is 500-950° C.

13. The method of claim 1, wherein in step (4), the reducing agent comprises at least one of sodium, calcium and magnesium.

14. The method of claim 1, wherein in step (4), a thermal reduction reaction temperature is 400-800° C.

15. The method of claim 1, wherein in step (4), the thermal reduction reaction is carried out under a protective atmosphere.

16. The method of claim 1, wherein in step (5), the solid-liquid separation is performed by vacuum filtration.

17. The method of claim 1, wherein in step (5), the washing is performed sequentially with an acid and water.

18. The method of claim 1, wherein in step (5), the drying is performed at a vacuum degree of 0.1-0.5 MPa and a temperature of 30-50° C.

19. A method for preparing vanadium powder or vanadium alloy powder from a vanadium-containing raw material, comprising:

(1) mixing the vanadium-containing raw material with an alkali compound to produce a first mixture, and then calcinating the first mixture at 700-900° C. for 3-10 h for oxidation to produce a calcinated product;

wherein in the first mixture of the vanadium-containing raw material and the alkali compound, the vanadium-containing raw material has a molar percentage content of 5-25% and the alkali compound has a molar percentage content of 75-95%; and the alkali compound is at least one compound selected from the group consisting of $Na_2O$, $K_2O$, NaOH, KOH, $Na_2CO_3$ and $K_2CO_3$;

(2) pulverizing the calcinated product obtained in step (1) to produce a vanadium-containing particles of 150-300 mesh and then dissolving the vanadium-containing particles followed by solid-liquid separation to produce a vanadium-containing solution; purifying the vanadium-containing solution followed by adding with CaO and/or $CaCl_2$ for vanadium precipitation to obtain an intermediate $CaV_2O_6$;

(3) mixing the intermediate $CaV_2O_6$ obtained in step (2) with a molten-salt medium to produce a second mixture, and dehydrating the second mixture at a vacuum degree of 0.1-0.3 MPa and a temperature of 150-450° C. followed by heating to 500-950° C. for melting to form a molten-salt reaction system;

wherein the molten-salt medium consists of 40-100% by molar percentage content of compound A and 0-60% by molar percentage content of compound B; and the compound A is at least one compound selected from the group consisting of $CaCl_2$, NaF and KF, and the compound B is at least one compound selected from the group consisting of NaCl, KCl, LiCl, $NaAlO_2$, $CaTiO_3$, $Na_2TiO_3$, $K_2TiO_3$ and $TiO_2$;

in the second mixture of $CaV_2O_6$ and the molten-salt medium, $CaV_2O_6$ has a molar percentage content of 2-12% and the molten-salt medium has a molar percentage content of 88-98%; and sodium metaaluminate is introduced during the mixing of the intermediate $CaV_2O_6$ with the molten-salt medium;

(4) adding a reducing agent to the molten-salt reaction system obtained in step (3) to carry out a thermal reduction reaction at 400-800° C. under an argon atmosphere to produce a thermal-reduced product; wherein the reducing agent comprises at least one of sodium, calcium and magnesium; and (5) subjecting the thermal-reduced product obtained in step (4) to vacuum filtration followed by washing sequentially with an acid and water and drying at a vacuum degree of 0.1-0.5 MPa and a temperature of 30-50° C. to obtain a target product.

* * * * *